US005147138A

United States Patent [19]

Gutner

[11] Patent Number: 5,147,138

[45] Date of Patent: Sep. 15, 1992

[54] DRAWER SLIDE AND GUIDE ASSEMBLY

[76] Inventor: Kenneth H. Gutner, 4505 Lindenwood La., Northbrook (Cook), Ill. 60062

[21] Appl. No.: 692,701

[22] Filed: Apr. 29, 1991

[51] Int. Cl.[5] ..... F16C 29/02

[52] U.S. Cl. ..... 384/21; 384/23; 384/37

[58] Field of Search ..... 384/21, 23, 20, 37, 384/41, 22

[56] References Cited

U.S. PATENT DOCUMENTS

Re. 28,344 2/1975 Monaco ..... 384/21
3,658,394 4/1972 Gutner ..... 384/21
4,892,368 1/1990 Goto et al. ..... 384/21
5,002,402 3/1991 Parvin ..... 384/23

*Primary Examiner*—Lenard A. Footland
*Attorney, Agent, or Firm*—Tilton, Fallon, Lungmus & Chestnut

[57] ABSTRACT

A sliding assembly for a furniture drawer including a C-shaped metal slide in combination with a T-shaped wooden guide, the slide being equipped with an integral, depending detent while the guide is equipped with a spring clip in a top groove receiving the slide detent so as to provide an overcomeable stop against drawer removal from an associated dresser, the bottom of the slot being generally U-shaped.

3 Claims, 1 Drawing Sheet

FIG. 1
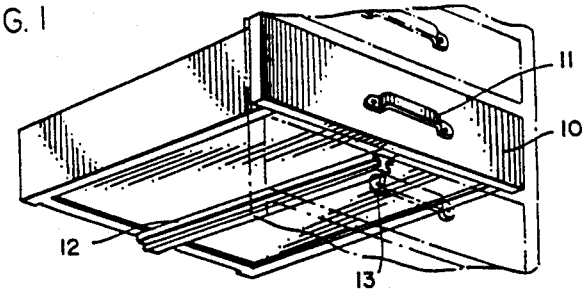
FIG. 2
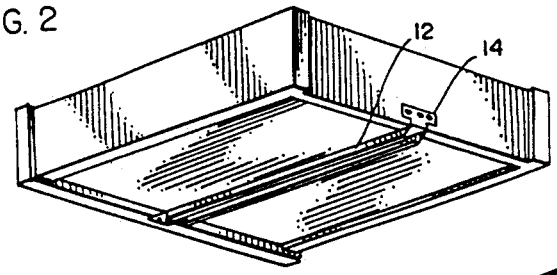
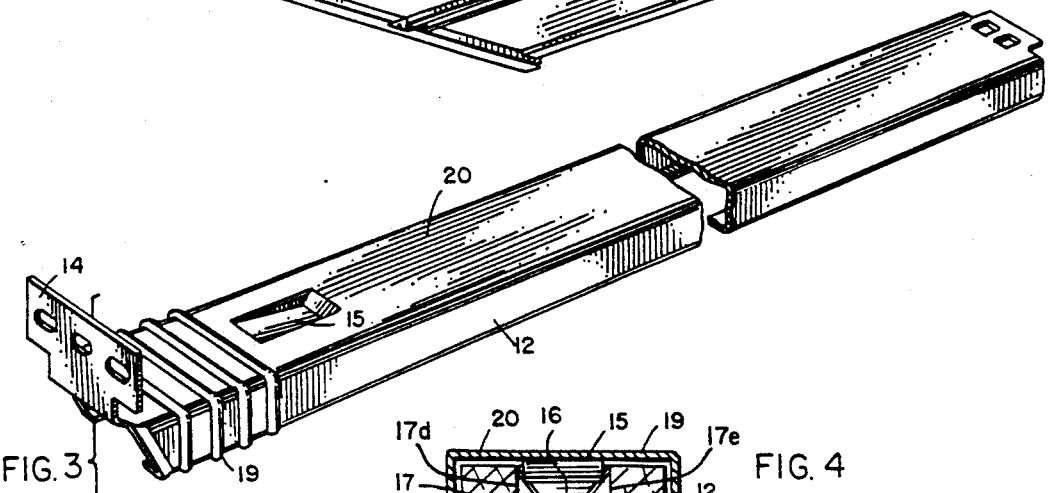
FIG. 3
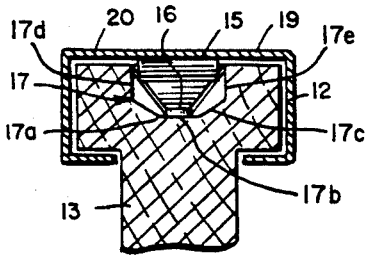
FIG. 4
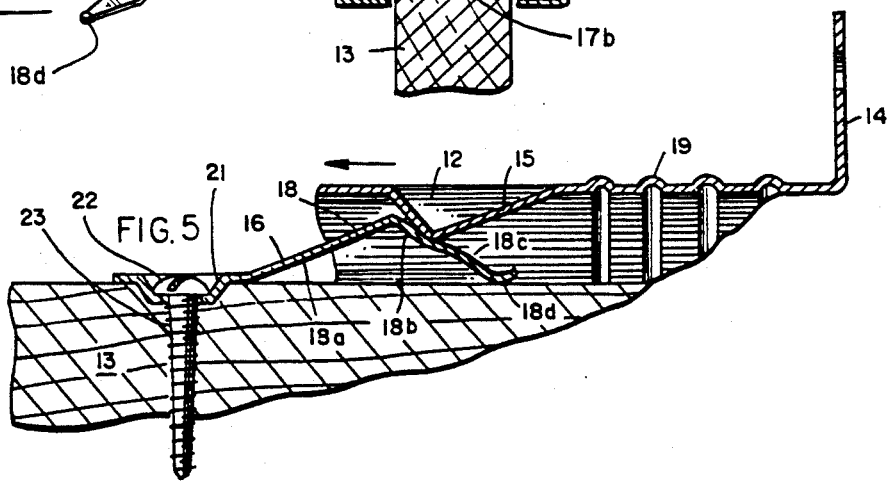
FIG. 5

DRAWER SLIDE AND GUIDE ASSEMBLY

BACKGROUND AND SUMMARY OF INVENTION

This invention relates to a drawer slide and guide assembly and constitutes an improvement on my prior U.S. Pat. No. 3,658,394.

PRIOR ART

In the prior patent, I provided a coacting spring clip means on a wood guide member and a detent on a metal slide member which make it possible to use wood in combination with metal for the slide-guide assembly, yet at the same time provide a positive stop against inadvertent pulling out of a dresser drawer.

The illustrated embodiment of the '394 patent was subject to the disadvantages of cracking of the wood guide and flattening out of the detent of the metal slide. Both problems were overcome at the bottom of the detent-receiving slot in the wood guide and by providing a narrower rear end of the clip means. Moreover, I have ascertained optimum geometric relationships of the interacting portions of the slide and guide.

BRIEF DESCRIPTION OF DRAWING

The invention is described in conjunction with an illustrative embodiment in the accompanying drawing, in which:

FIG. 1 is a fragmentary perspective view, partially in phantom, of a section of a dresser employing the inventive sliding assembly;

FIG. 2 is a perspective view of a dresser drawer of the type seen in FIG. 1, but from the rear so as to further illustrate the character of the slide assembly;

FIG. 3 is a fragmentary perspective view, partially in exploded form, showing the cooperating portions of the drawer stop;

FIG. 4 is an enlarged transverse sectional view of the slide and guide assembly of the invention; and FIG. 5 is a longitudinal sectional view on an enlarged scale of the parts seen in FIGS. 3 and 4.

DETAILED DESCRIPTION

Inasmuch as the instant invention is an improvement on my '394 patent, I have patterned for purposes of clarity and ease of understanding drawing views and the ensuing description after those of the '394 patent.

In FIG. 1, the numeral 10 designates a dresser drawer which is equipped with a front handle, as at 11, and a C-shaped slide 12 adapted to move on a stationary guide 13 (compare FIG. 4). In FIG. 2, the same drawer is seen, but from the rear, wherein the slide 12 is seen to be equipped with an upturned portion 14.

The upper portion of the guide 13 is generally T-shaped, while the slide 12 is generally channel shaped. In the metal channel 12, a detent 15 projects downwardly from the top wall of the channel. Thus, the detent 15 can be moved into selective engagement with a metal spring clip 16 provided on the interior upstanding face of the guide 13. For this purpose, a slot generally designated 17 is provided in the top surface of the guide 13 to accommodate the mounting of the spring clip 16.

As seen in the lower left portion of FIG. 3, the spring clip 16 has an intermediate raised portion 18 which coacts with the detent 15 in limiting withdrawal of the drawer 10 from its associated furniture piece. However, it is possible to overcome the resilient resistance of the spring clip 16 so that the drawer can be completely withdrawn, as by having the detent 15 force the upwardly projecting portion 18 downwardly and pass thereover—as seen in FIG. 5 when the guide 12 is moving to the left as indicated by the arrow.

As seen best in FIG. 5, the spring clip 16 is located adjacent the forward end of the guide 13 while the detent 15 is located adjacent the rear of the slide 12. The detent 15 is a relatively minor upset area in the bight portion 20 adjacent integral ribs 19. The spring clip 16 has a straight V portion, as at **18*a* and 18*b* (see FIG. 5) which terminates in a rear foot or bearing portion at 18*c* and 18*d*. At the other or forward end when installed, the spring clip 16 is equipped with a circular opening 21 which receives a wood screw 23 equipped with a head 22**.

INVENTION

According to the instant invention, I have changed the shape of the lower portion of the slot 17. It is now essentially rounded so as to provide a general U-shape in cross section. More particularly, the bottom of the slot 17 is defined by segmental planes as at **17*a*, 17*b* and 17*c* (see FIG. 4). The segments 17*a*, 17*c* are optimally inclined at an angle of about 30° to the segment 17*b* which is generally perpendicular to the vertical side walls 17*d* and 17*e*. Each of the segments is about the same length. In one illustrative embodiment, the width of the slot 17 is 0.375" and the width of the segment 17*b*** is 0.156".

The provision of the U-shaped groove has substantially avoided the cracking problem of the wood guide 13 of the prior art construction by eliminating stress concentrations at the bottom corners while still providing ample bearing surface for the now-narrowed foot portion **18*d* of the spring clip 16 (see also FIG. 3**).

The consequent narrowing of the spring clip 16 provides a second advantageous result in reducing the pressure in the detent 15, thereby reducing the tendency to flatten.

Excellent results are obtainable when the height of the segments **17*a* or 17*c*** is in the range of about ¼ to about ½ the mid-plane depth of the slot. In the illustration above given, the maximum depth of the slot is 0.218".

The narrowing of the spring clip 16 is not only relative to the prior art but also relative to the forward end portion of the spring clip 16, i.e., the portion containing the opening 21 which receives the wood screw 23. Now, the rear or foot portion **18*d* is less than half the width of the slot 17 which develops full bearing on the bottom of the slot 17 and without binding on or gouging of the segments 17*a*, 17*c***.

In operation, the spring clip 16 projects above the slot bottom wall about 0.1" so as to definitely engage the detent 15 and develop an overcomeable interferring action so as to signal the person withdrawing the drawer that it is virtually open to it smaximum extent before complete drawer withdrawal. The spring clip and slide are both advantageously made of the same gauges of metal (about 0.025"). This results in a slight deformation or deflection of the detent (as well as the spring clip 16) to provide a definite signal yet one which, even after repeated withdrawal actions, does not damage the interferring elements.

While in the foregoing specification a detailed description of an embodiment of the invention has been set down for the purpose of illustration, many variations in the details hereingiven may be made by those skilled in the art without departing from the spirit and scope of the invention.

I claim:

1. A sliding assembly for the drawer of a furniture piece comprising a relatively elongated steel slide adapted to be mounted on a drawer and having a generally C-shaped cross section and a relatively elongated guide adapted to be mounted on a furniture piece having a generally T-shaped cross section on which said slide is slidingly mounted, a longitudinally extending slot in the top of said wood guide, a detent on said metal slide projecting into said slot, and a spring clip in said slot of the wood guide for resilient engagement with said detent, said detent being adjacent one end of said slide and said spring clip being adjacent the other end of said guide whereby said detent and spring clip serve to restrict withdrawal of a drawer from a furniture piece, said spring clip including an elongated generally flat resilient unitary element secured at one end to said guide, said spring clip having a longitudinally arched portion intermediate the ends thereof and an integral foot portion adjacent the other end, said foot portion being substantially narrower than the portion of said element adjacent said one end, said slot having a generally U-shaped bottom in cross section to provide a substantially flat bearing area for said foot portion.

2. The structure of claim 1 in which said U-shaped bottom is generally segmental to provide three longitudinally extended segmental planes between the sidewalls of said U-shaped slot, said spring clip foot portion being less than about ½ of the width of said slot to develop said substantially flat bearing area.

3. The structure of claim 2 in which said segmental bottom includes a segmental plane centrally disposed between said U-shaped slot sidewalls and flanked by upwardly angled segmental planes, the height of said segmental planes being in the range of about ¼ to ½ of the maximum depth or said slot.

* * * * *